US006026357A

United States Patent [19]

Ireton et al.

[11] Patent Number: 6,026,357

[45] Date of Patent: Feb. 15, 2000

[54] FIRST FORMANT LOCATION DETERMINATION AND REMOVAL FROM SPEECH CORRELATION INFORMATION FOR PITCH DETECTION

[75] Inventors: Mark A. Ireton; John G. Bartkowiak, both of Austin, Tex.

[73] Assignee: Advanced Micro Devices, Inc., Sunnyvale, Calif.

[21] Appl. No.: 08/957,595

[22] Filed: Oct. 24, 1997

Related U.S. Application Data

[63] Continuation-in-part of application No. 08/647,843, May 15, 1996, Pat. No. 5,937,374.

[51] Int. Cl.[7] ..... G10L 3/02

[52] U.S. Cl. ..... 704/207; 704/209

[58] Field of Search ..... 704/207, 209, 704/503, 504

[56] References Cited

U.S. PATENT DOCUMENTS

| | | | |
|---|---|---|---|
| 4,791,671 | 12/1988 | Willems | 704/217 |
| 5,313,553 | 5/1994 | Laurent | 704/207 |
| 5,577,160 | 11/1996 | Hosom et al. | 704/209 |
| 5,704,000 | 12/1997 | Swaminathan et al. | 704/207 |
| 5,799,271 | 8/1998 | Byun . | |
| 5,812,966 | 9/1998 | Byun et al. | 704/207 |

OTHER PUBLICATIONS

Chen, "One–Dimensional Digital Signal Processing" Marcel Dekker, pp. 161–162, 1979.

Microsoft "Computer Dictionary" Microsoft Press pp. 290 and 291, 1994.

Rabiner, et al, "Digital Processing of Speech Signals," Bell Laboratories, published by Prentice–Hall, Inc., Englewood Cliffs, New Jersey, 1978, pp. 441–450.

*Primary Examiner*—David R. Hudspeth
*Assistant Examiner*—Harold Zintel
*Attorney, Agent, or Firm*—Conley, Rose & Tayon; Jeffrey C. Hood

[57] ABSTRACT

A vocoder system and method for estimating the pitch of a speech signal. The speech signal comprises a stream of digitized speech samples. The speech samples are partitioned into frames. For each frame of the speech signal, the following processing steps are performed. First, an optimal order-two inverse filter is determined based on the samples of the speech frame. Second, a dominant formant frequency is calculated from the coefficients of the optimal order-two inverse filter. Third, an autocorrelation function is calculated on the samples of the speech frame. The autocorrelation is performed for a range of time-delay values over which the pitch period and its multiples might be expected to occur. Fourth, the peaks of the autocorrelation function are analyzed incorporating the knowledge of the dominant formant period (which is the inverse of the dominant formant frequency). Normally, the dominant formant is the first formant. Thus, the dominant formant period defines the expected time-delay for the first formant peak in the autocorrelation function. As such, any peak in the autocorrelation function occurring with a time-delay equal to the dominant formant period is treated with increased caution before being accepted as the pitch period.

16 Claims, 9 Drawing Sheets

Pitch Estimation Method According to the Present Invention

Representation of speech signals.

Range of bit for various types of speech representations.

Source-system model of speech production.

General discrete-time model for speech production.

Block diagram of simplified model for speech production.

Pitch Estimation Method According to the Present Invention

Calculation of Dominant Formant Frequency

Step 1035 of Figure 10, i.e. Analyzing Peaks of the Autocorrelation Function

FIRST FORMANT LOCATION DETERMINATION AND REMOVAL FROM SPEECH CORRELATION INFORMATION FOR PITCH DETECTION

CONTINUATION DATA

This is a continuation-in-part of application Ser. No. 08/647,843 titled "System and Method for Improved Pitch Estimation Which Performs First Formant Energy Removal For A Frame Using Coefficients From A Prior Frame" filed May 15, 1996, now U.S. Pat. No. 5,937,374 whose inventors are John G. Bartkowiak and Mark A. Ireton.

FIELD OF THE INVENTION

The present invention relates generally to a vocoder which receives speech waveforms and generates a parametric representation of the speech waveforms, and more particularly to an improved vocoder system and method for performing pitch estimation.

DESCRIPTION OF THE RELATED ART

Digital storage and transmission of voice or speech signals has become increasingly prevalent in modern society. Digital storage of a speech signal comprises generating a digital representation of the speech signal and then storing the digital representation in memory. As shown in FIG. 1, a digital representation of a speech signal can generally be either a waveform representation or a parametric representation. A waveform representation of a speech signal comprises preserving the "waveshape" of the analog speech signal through a sampling and quantization process.

A parametric representation of a speech signal implies the choice of a model for speech production. The output of the model is governed by a set of parameters which evolve in time. A parametric representation aims at specifying the time-evolution of the model parameters so that the given speech signal is achieved as the model output. Thus a parametric representation of a speech signal is accomplished by generating a digital waveform representation using speech signal sampling and quantization, and then further processing the digital waveform to determine the parameters of the speech production model, or more precisely, the discrete-time evolution of these parameters. The parameters of the speech production model are generally classified as either excitation parameters, which are related to the source of the speech excitation, or vocal tract response parameters, which are related to the physical/acoustic modulation of the speech excitation by the vocal tract.

FIG. 2 illustrates a comparison of waveform representations and parametric representations of speech signals according to the data transfer rate required for real-time transmission. As shown, parametric representations of speech signals require a lower data rate, or number of bits per second, than waveform representations. A waveform representation requires from 15,000 to 200,000 bits per second to represent and/or transfer a typical speech signal, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. The speech production model is a model based on human speech production anatomy. A parametric representation of a speech signal specifies the time-evolution of the model parameters so that the speech signal is realized as the model output.

Speech sounds can generally be classified into three distinct classes according to their mode of excitation. Voiced sounds are sounds produced by vibration or oscillation of the human vocal chords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation and a time varying linear system which models propagation of sound through the vocal tract and radiation of the sound at the mouth. Therefore, this model separates the excitation features of sound production from the vocal tract and radiation features. The excitation generator creates a signal comprising either (a) a train of glottal pulses as the source of excitation for voiced sounds, or (b) randomly varying noise as the source of excitation for unvoiced sounds. The time-varying linear system models the various effects of the vocal tract on the sound excitation. The output of the speech production model is determined by a set of parameters which affect the operation of the excitation generator and the time-varying linear system.

Referring now to FIG. 4, a more detailed speech production model is shown. As shown, this model includes an impulse train generator for generating an impulse train corresponding to voiced sounds, and a random noise generator for generating random noise corresponding to unvoiced sounds. One parameter of the speech production model is the pitch period, which is supplied to the impulse train generator to control the instantaneous spacing of the impulses in the impulse train. Over short time intervals the pitch parameter does not change significantly. Thus the impulse train generator produces an impulse train which is approximately periodic (with period equal to the pitch period) over short time intervals. The impulse train is provided to a glottal pulse model block which models the glottal system. The output from the glottal pulse model block is multiplied by an amplitude parameter $A_v$ and provided through a voiced/unvoiced switch to a vocal tract model block. The random noise output from the random noise generator is multiplied by an amplitude parameter $A_N$ and is provided through the voiced/unvoiced switch to the vocal tract model block. The voiced/unvoiced switch controls which excitation generator is connected to the time-varying linear system. Thus, the voiced/unvoiced switch receives an input parameter which determines the state of the voiced/unvoiced switch.

The vocal tract model block generally relates the volume velocity of the speech signal at the source to the volume velocity of the speech signal at the lips. The vocal tract model block receives vocal tract parameters which determine how the source excitation (voiced or unvoiced) is transformed within the vocal tract model block. In particular, the vocal tract parameters determine the transfer function V(z) of the vocal tract model block. The resonant frequencies of the vocal tract, which correspond to the poles of the transfer function V(z), are referred to as formants. The output of the vocal tract model block is provided to a radiation model which models the effect of pressure at the lips on the speech signals. Therefore, FIG. 4 illustrates a general discrete-time model for speech production. The model parameters, including pitch period, voiced/unvoiced selection, voiced amplitude $A_v$, unvoiced amplitude $A_N$, and the vocal tract parameters, control the operation of the speech production model. As the model parameters evolve in time, a synthesized speech waveform is generated at the output of the speech production model.

Referring now to FIG. 5, in some cases it is desirable to combine the glottal pulse, radiation, and vocal tract model blocks into a single transfer function. This single transfer function is represented in FIG. 5 by the time-varying digital filter block. As shown, an impulse train generator and random noise generator each provide outputs to a voiced/unvoiced switch. The output u(n) from the switch is multiplied by gain parameter G, and the resultant product Gu(n) is provided as input to the time-varying digital filter. The time-varying digital filter performs the operations of the glottal pulse model block, the vocal tract model block, and the radiation model block shown in FIG. 4. The output s(n) of the time-varying digital filter comprises a synthesized speech signal.

The time-varying digital filter of FIG. 5 obeys the recursive expression $$s(n) = \sum_{k=1}^{p} a_k s(n-k) + G \cdot u(n), \tag{1}$$

where p is the filter order. The coefficients $a_k$ determine the properties of the time-varying digital filter. In the z-domain, the time-varying digital filter has the following all-pole transfer function:

$$H(z) = \frac{S(z)}{U(z)} = \frac{G}{1 - \sum_{k=1}^{p} a_k z^{-k}}, \tag{2}$$

wherein S(z) is the z-transform of the output sequence s(n), and U(z) is the z-transform of the signal u(n).

In this framework, the problem of speech compression can be expressed as follows. Given a sampled speech signal, formally assume that the sampled speech signal was produced by the above model for speech production. Divide the sampled speech signal into short time blocks. For each speech block, estimate the parameters of the speech production model, i.e. the coefficients $a_k$, the pitch period P, gain G, and the state of the voiced/unvoiced switch. Thus, one set of parameters is produced for each frame of speech data, and the speech signal is encoded as an ordered sequence of parameter sets. Since the storage required for a parameter set is much smaller than the storage required for the corresponding speech block, a significant data compression is achieved.

The complementary problem of speech reconstruction proceeds in the opposite direction. Given a sequence of parameter sets which represent a speech signal, the speech signal is regenerated by supplying the parameter sets to the speech production model in natural order. The resulting blocks of synthesized speech represent the original speech signal.

One key aspect of speech compression involves the pitch estimation algorithm. The estimated pitch period sequence is used later to re-generate the speech waveform. In particular, the pitch period sequence is used by the impulse-train generator to generate an impulse train signal which stimulates the time-varying digital filter. Pitch estimation errors in speech have a highly damaging effect on the reproduced speech quality. Therefore, pitch estimation algorithms which combine accuracy and computational efficiency are widely sought. It is noted that, for an all digital system, the pitch parameter is constrained to be a multiple of the sampling interval of the system.

Pitch detection algorithms based on time-domain autocorrelation have been widely employed. For any periodic signal, it is a well known fact that the autocorrelation function achieves a absolute maximum value at time delays equal to the fundamental period and its integer multiples. Due to the locally periodic nature of speech, a high value for the correlation function will register at multiples of the pitch period, i.e. at 2, 3, 4, and 5 times the pitch period, producing multiple peaks in the correlation. Ostensibly, the problem of pitch period detection is one of identifying a series of large amplitude correlation peaks which have this regular time-delay structure. Namely, the large amplitude peaks must line up with time-delays that are 2, 3, 4, and 5 times some fundamental time-delay. The pitch period is then equal to this fundamental time-delay.

In practice, the autocorrelation analysis is complicated by the fact that some speech signals have a particularly strong (high energy) first formant which results in a pronounced peak in the autocorrelation function. Empirical studies of speech reveal that the pitch achieves frequencies as high as 500 Hz, while the first formant can achieve frequencies as low as 350 Hz. In terms of period, the pitch achieves periods as low as 2.00 msec, while the first formant achieves periods as high as 2.86 msec. Thus, when the first formant has high energy and achieves a period larger than 2.00 msec, the autocorrelation peak due to the first formant can very easily be confused with the pitch peak. It is noted that only the first formant occurs with frequencies low enough to be confused with the pitch.

A host of prior art techniques deal with this complication by pre-filtering the speech signal with a filter designed to compensate for the spectral shaping effects of the vocal tract. In particular, for each block of speech data, the coefficients $a_k$ of the time-varying digital filter H(z) are estimated. The filter H(z) models the response of the vocal tract. The block of speech data is filtered using an inverse filter A(z) whose transfer function is the inverse of transfer function H(z). Namely, $$A(z) = 1 - \sum_{k=1}^{p} a_k z^{-k}$$

After the inverse filtering, the filtered signal is supplied to the autocorrelation analysis for pitch estimation. Since components of the speech signal near the formant frequencies have been attenuated, the autocorrelation peaks due to the pitch period and its multiples are more clearly distinguished in the autocorrelation function. The accuracy of the pitch estimation increases at the expense of increased computational load due to the pre-filtering. Such prior art techniques have aimed at modeling two or more formants in the vocal tract response, and therefore have employed filter orders of four or more. As mentioned above, the first formant is the only formant which occurs with periods high enough to be confused with the pitch period in autocorrelation analyses. Thus, the computational effort of modeling two or more formants in the speech signal is not strictly justified. Thus, it is apparent that a system and method for performing pitch estimation are needed wherein the computational advantages implicit in modeling only the first formant are effectively realized.

SUMMARY

The present invention employs an order-two FIR filter to model the contribution of the first formant in the speech signal, whereas prior art pitch estimators employ filters with order four or more to model the first and higher formants. Since the computational effort required to solve for the FIR filter coefficients is a polynomial function of the order, smaller filter orders are strongly favored. Thus, the present invention achieves pitch estimation with less computational effort than prior art pitch estimators.

The present invention comprises an improved vocoder system and method for estimating the pitch of a speech signal. The speech signal comprises a stream of digitized speech samples. The speech samples are partitioned into frames. For each frame of the speech signal, the following processing steps are performed. First, an optimal order-two inverse filter is determined based on the samples of the speech frame. Second, a dominant formant frequency is calculated from the coefficients of the optimal order-two inverse filter. Third, an autocorrelation function is calculated on the samples of the speech frame. The autocorrelation is performed for a range of time-delay values over which the pitch period and its multiples might be expected to occur. Fourth, the peaks of the autocorrelation function are analyzed incorporating the knowledge of the dominant formant period (which is the inverse of the dominant formant period). Normally, the dominant formant is the first formant. Thus, the dominant formant period defines the expected time-delay for the first formant peak in the autocorrelation function. As such, any peak in the autocorrelation function occurring with a time-delay equal to the dominant formant period is treated with increased caution before being accepted as the pitch period.

The optimal order-two inverse filter is determined by computing an order-two inverse filter at various locations within the speech frame. For each order-two inverse filter an energy value is calculated which represents the proportion of energy which would remain if the speech signal were filtered with the order-two inverse filter. The order-two inverse filter which minimizes the energy proportion is chosen to be the optimal order-two inverse filter.

A dominant formant frequency is calculated from the coefficients of the optimal order-two inverse filter. The optimal order-two filter has a quadratic transfer function which is characterized by two coefficients: $1-a_1z^{-1}-a_2z^{-2}$. Thus, the transfer function has two complex-conjugate zeroes. The angle of one of these zeros is calculated and converted into a frequency according to the relation:

$$\text{frequency}=\frac{\text{angle}\times\text{SampleRate}}{2\pi}$$

In the present invention, the preferred sample rate is 8 kHz. The resulting frequency is used as an estimate of the dominant formant frequency.

An autocorrelation is performed for a range of time-delay values which span the expected range for the pitch period and its integer multiples (up to five multiples). The peaks of the autocorrelation function are identified. This involves applying a threshold of the autocorrelation function so that low-amplitude peaks are eliminated. A resulting list of peak time-delays (time-delays for which peaks occur) is analyzed. In particular, if a peak occurs with time-delay equal to the dominant formant period, then the system and method of the present invention checks for the occurrence of peaks at the second, third, fourth, and fifth multiples of the dominant formant period. If peaks occur at all of these multiples, then the dominant formant period is declared to be the pitch period. If peaks do not occur at all of these multiples, then the dominant formant period is removed from the list of peak time-delays, and the list of peak time-delays is scanned for the occurrence of five peaks with time-delays conforming to the pattern {x, 2x, 3x, 4x, 5x}. In other words, the list of peak time-delays is searched for five time-delays which form the second, third, fourth, and fifth multiple of a fundamental time-delay. The fundamental time-delay is declared to be the pitch period.

BRIEF DESCRIPTION OF THE DRAWINGS

A better understanding of the present invention can be obtained when the following detailed description of the preferred embodiment is considered in conjunction with the following drawings, in which.

Figure 1:
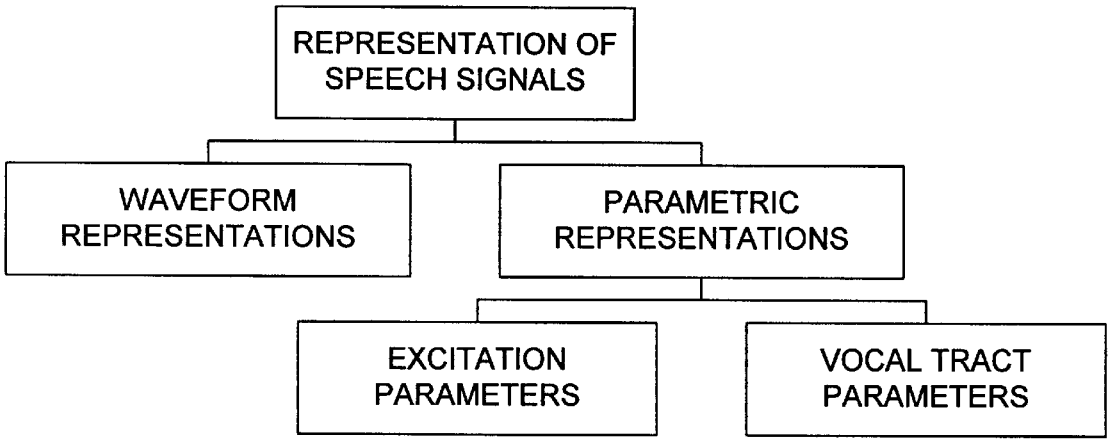
FIG. 1 (PRIOR ART)
FIG. 1 illustrates waveform representation and parametric representation methods used for representing speech signals.
Figure 2:
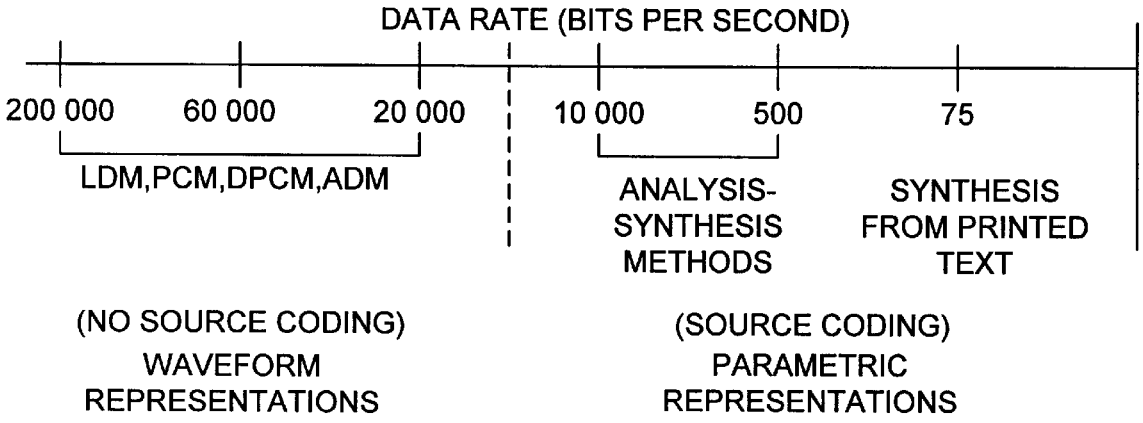
FIG. 2 (PRIOR ART)
FIG. 2 illustrates a range of bit rates required for the transmission of the speech representations illustrated in FIG. 1.
Figure 3:
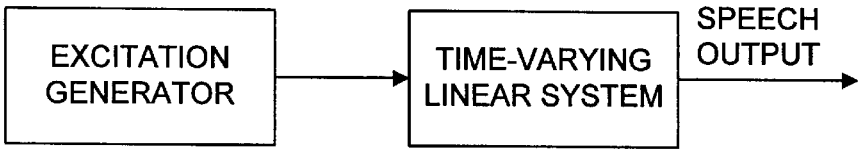
FIG. 3 (PRIOR ART)
FIG. 3 illustrates a basic model for speech production.
Figure 4:
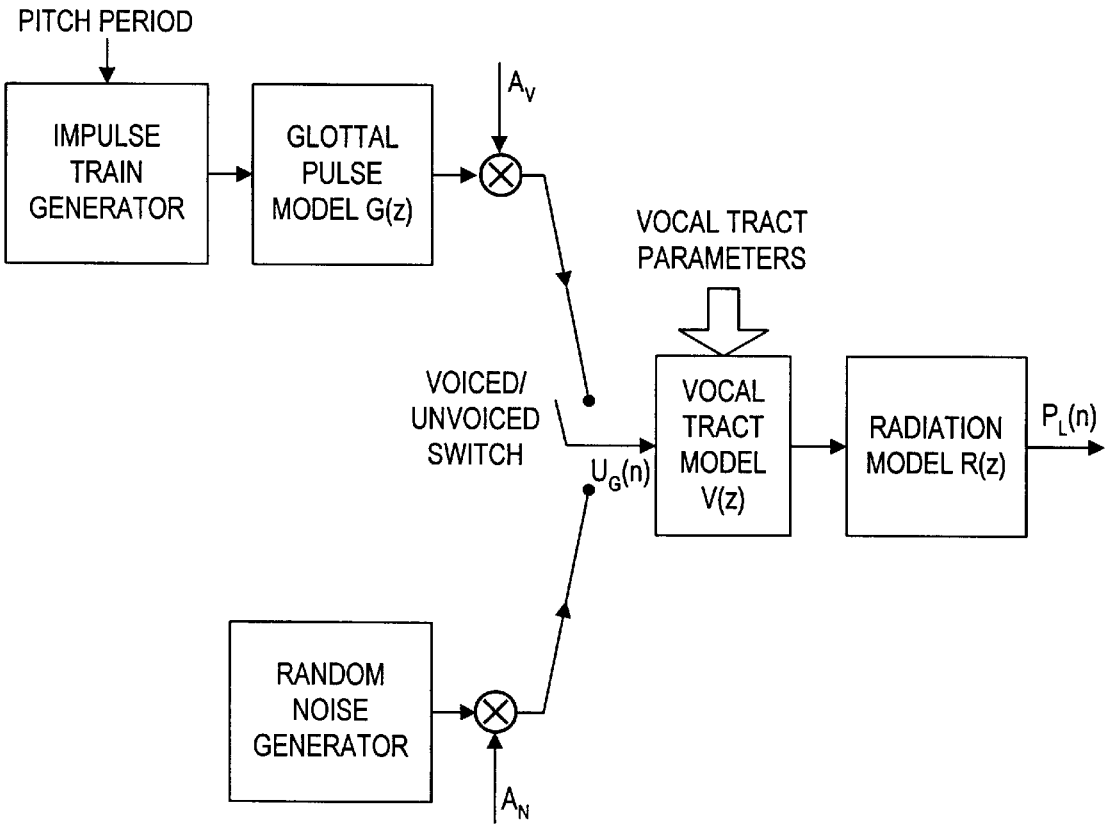
FIG. 4 (PRIOR ART)
FIG. 4 illustrates a generalized model for speech production.
Figure 5:
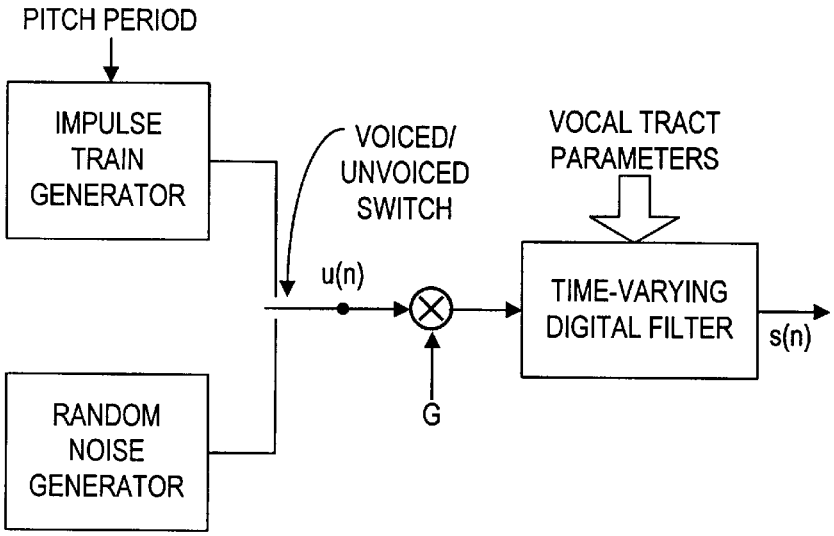
FIG. 5 (PRIOR ART)
FIG. 5 illustrates a model for speech production which includes a single time-varying digital filter.

While the invention is susceptible to various modifications and alternative forms specific embodiments are shown by way of example in the drawings and will herein be described in detail. It should be understood however, that drawings and detailed description thereto are not intended to limit the invention to the particular form disclosed. But on the contrary the invention is to cover all modifications, equivalents and alternatives following within the spirit and scope of the present invention as defined by the appended claims.

DETAILED DESCRIPTION OF THE PREFERRED EMBODIMENT

Incorporation by Reference

For general information on speech coding, please see Rabiner and Schafer, "Digital Processing of Speech Signals", Prentice Hall, 1978 which is hereby incorporated by reference in its entirety.

Voice Storage and Retrieval System

Figure 6:
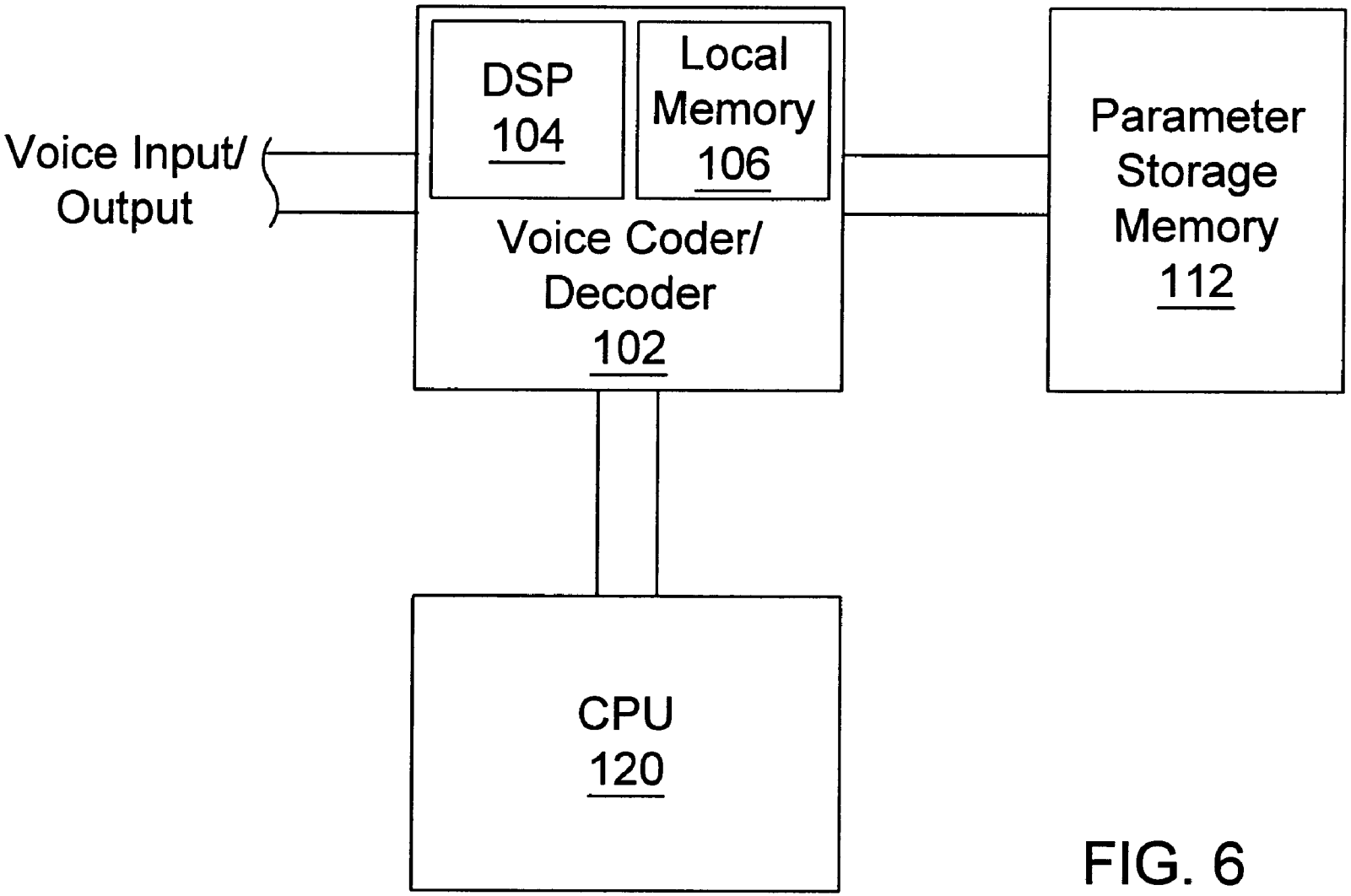
FIG. 6 is a block diagram of a speech storage system according to one embodiment of the present invention.

Referring now to FIG. 6, a block diagram illustrating a voice storage and retrieval system or vocoder according to one embodiment of the invention is shown. The voice storage and retrieval system shown in FIG. 6 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (vocoder or codec) 102. The voice coder/decoder 102 preferably includes one or more digital signal processors (DSPs) 104, and local DSP memory 106. The local memory 106 serves as an analysis memory used by the DSP 104 in performing voice coding and decoding functions, i.e., voice compression and decompression, as well as optional parameter data smoothing. The local memory 106 preferably operates at a speed equivalent to the DSP 104 and thus has a relatively fast access time. In the preferred embodiment, the DSP 104 analyzes speech data to determine a filter for first Formant removal according to the present invention.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 7:
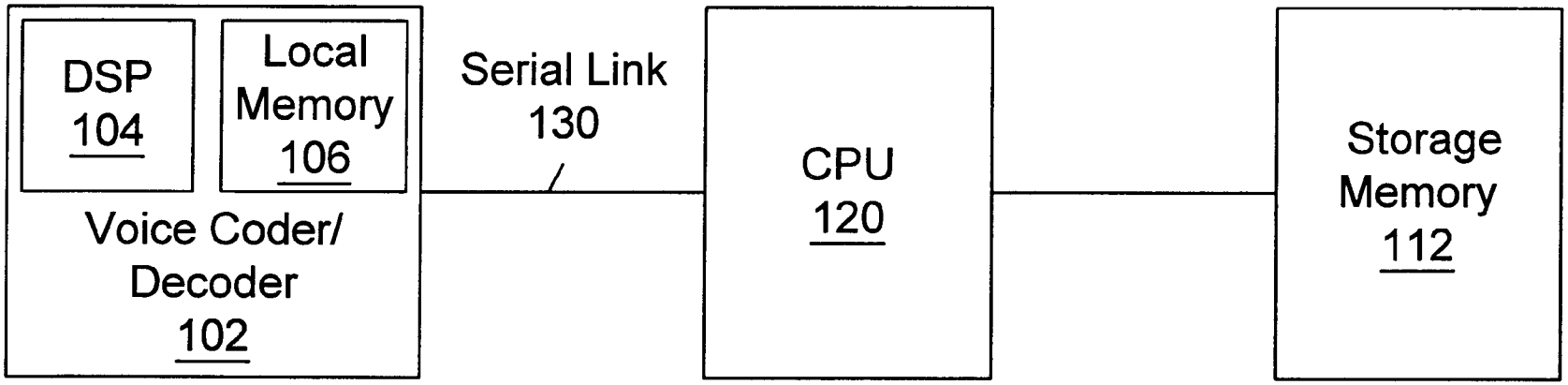
FIG. 7 is a block diagram of a speech storage system according to a second embodiment of the present invention.

Referring now to FIG. 7, an alternate embodiment of the voice storage and retrieval system is shown. Elements in FIG. 7 which correspond to elements in FIG. 6 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSPs 104A and 104B control the demand for parameters in the storage memory 112 and randomly accesses desired parameters in the storage memory 112 regardless of how the parameters are stored. The embodiment of FIG. 7 can also more closely resemble the embodiment of FIG. 6, whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 8:
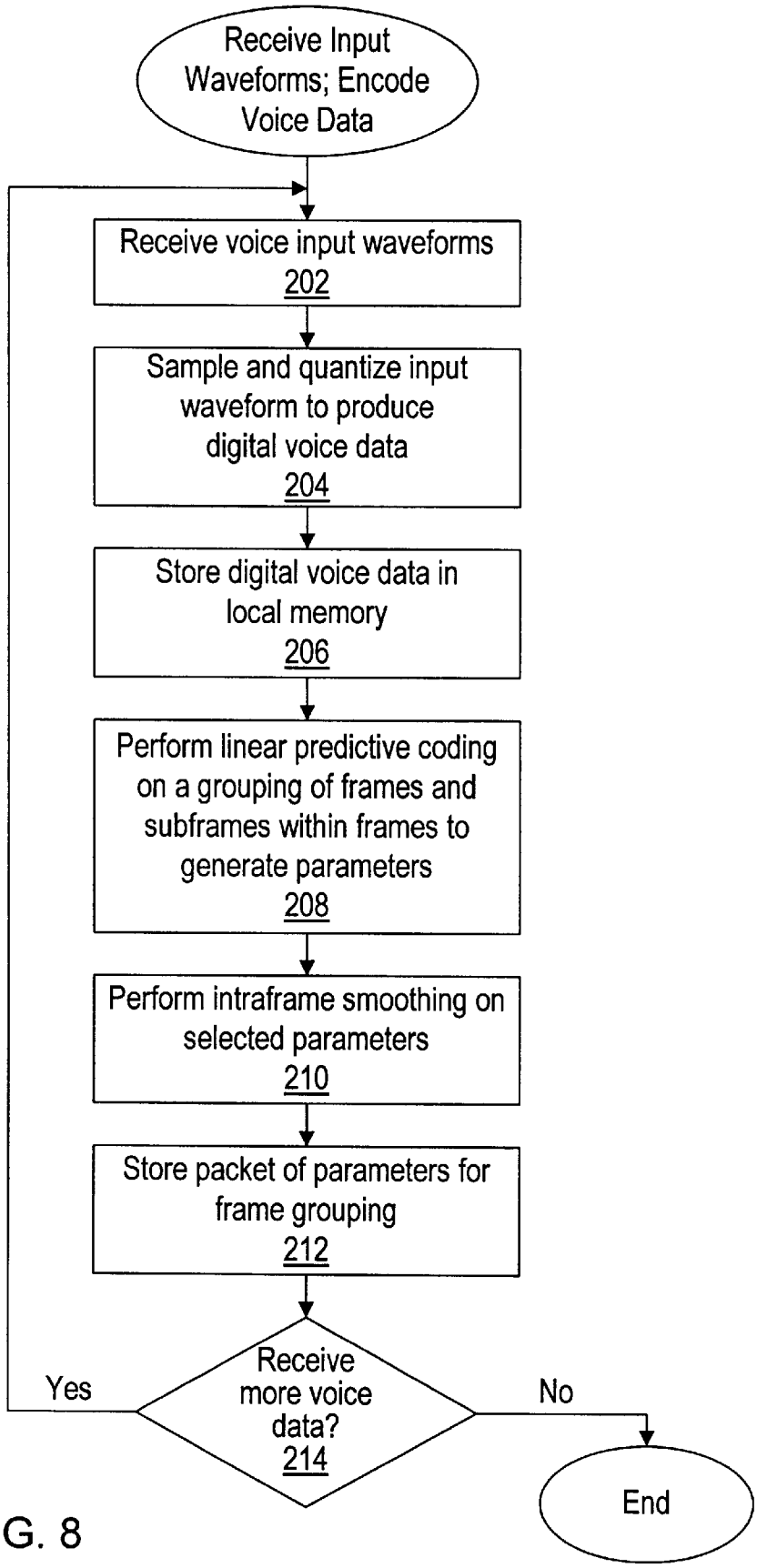
FIG. 8 is a flowchart diagram illustrating operation of speech signal encoding.

Referring now to FIG. 8, a flowchart diagram illustrating operation of the system of FIG. 6 encoding voice or speech signals into parametric data is shown. This figure illustrates one embodiment of how speech parameters are generated, and it is noted that various other methods may be used to generate the speech parameters using the present invention, as desired.

In step 202 the voice coder/decoder (vocoder) 102 receives voice input waveforms, which are analog waveforms corresponding to speech. In step 204 the vocoder 102 samples and quantizes the input waveforms to produce digital voice data. The vocoder 102 samples the input waveform according to a desired sampling rate. After sampling, the speech signal waveform is then quantized into digital values using a desired quantization method. In step 206 the vocoder 102 stores the digital voice data or digital waveform values in the local memory 106 for analysis by the vocoder 102.

While additional voice input data is being received, sampled, quantized, and stored in the local memory 106 in steps 202–206, the following steps are performed. In step 208 the vocoder 102 performs encoding on a grouping of frames of the digital voice data to derive a set of parameters which describe the voice content of the respective frames being examined. Various types of coding methods, including linear predictive coding, may be used. It is noted that any of various types of coding methods may be used, as desired. For more information on digital processing and coding of speech signals, please see Rabiner and Schafer, *Digital Processing of Speech Signals*, Prentice Hall, 1978, which is hereby incorporated by reference in its entirety. The present invention includes a novel system and method for calculating a first formant filter. Since the first formant filter has an order smaller than in prior art systems, the filter coefficients are calculated with less computational effort.

In step 208 the vocoder 102 develops a set of parameters for each frame of speech which represent the characteristics of the speech signal. This set of parameters includes a pitch parameter, a voiced/unvoiced parameter, a gain parameter, a magnitude parameter, and a multi-based excitation parameter, among others. The vocoder 102 may also generate other parameters which span a grouping of multiple frames.

Once these parameters have been generated in step 208, in step 210 the vocoder 102 optionally performs intraframe smoothing on selected parameters. In an embodiment where intraframe smoothing is performed, a plurality of parameters of the same type are generated for each frame in step 208. Intraframe smoothing is applied in step 210 to reduce this plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the vocoder 102 stores this packet of parameters in the storage memory 112 in step 212. If more speech waveform data is being received by the voice coder/decoder 102 in step 214, then operation returns to step 202, and steps 202–214 are repeated.

Figure 9:
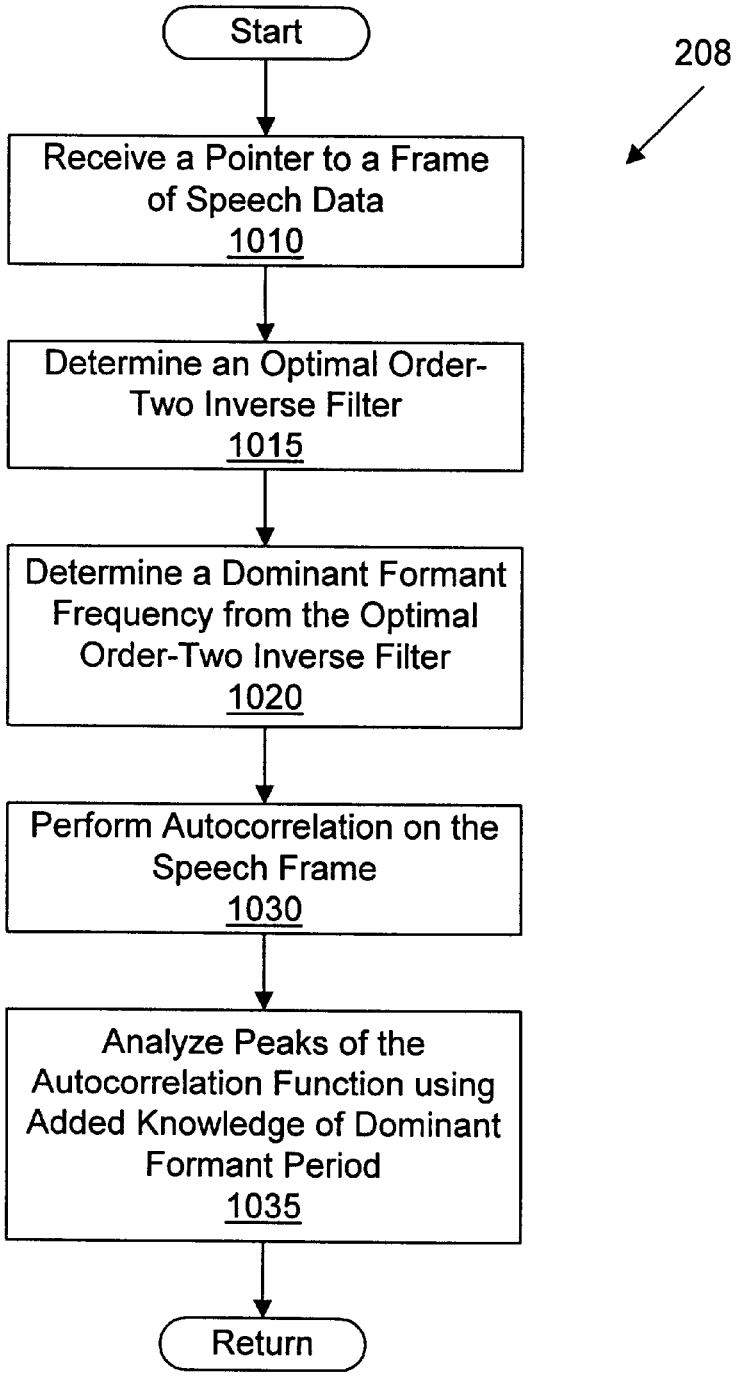
FIG. 9 is a flowchart illustrating the pitch estimation method according to the present invention.

FIG. 9—Pitch Estimation Method, First Embodiment

Referring now to FIG. 9, a block diagram is shown illustrating the pitch estimation method according to the present invention. The pitch estimation method comprises a part of step 208 of FIG. 8. The pitch estimation method operates on a frame of speech data stored in local memory 106. The frame comprises a set of consecutive samples of a speech waveform. Thus, in step 1010, the pitch estimation method commences with receiving a pointer InPtr to the speech frame. The pointer InPtr points to the first sample of the speech frame in local memory 106.

In step 1015, the samples of the speech frame are used to determine an optimal order-two inverse filter. The optimal order-two inverse filter has a transfer function A(z) given by $$A(z)=1-a_1z^{-1}a_2z^{-2},$$

and thus is completely specified by the coefficients $a_1$ and $a_2$. The method for determining the optimal order-two inverse filter will be explained below (see FIG. 10).

In step 1020, the optimal order-two inverse filter A (z) is analyzed to determine if a dominant formant frequency $f_d$ can be identified. If so, the dominant formant frequency $f_d$ is calculated. If a dominant formant frequency cannot be identified from the optimal order-two inverse filter A(z), an indication to this effect is provided. Step 1020 will be described in more detail below (see FIG. 11).

In step 1030, an autocorrelation is performed on the frame of speech data. Namely, the calculation $$R(\tau)=\sum_{n=0}^{N-1}s(n)s(n+\tau)$$

is performed for a range of integer time-delay values τ, where the integer N denotes the number of samples in the speech frame, and s(n) denotes the $n^{th}$ sample of the speech frame. The range of time-delay value τ is chosen to capture the range of possible value for the pitch period and its multiples.

In step 1035, the peaks of the autocorrelation function are analyzed to determine the pitch period. In step 1035, the fact that the dominant formant has period $T_d=1/f_d$ is incorporated into the peak analysis to provide a more robust pitch estimation algorithm. Step 1035 is described in detail below.

It was mentioned above that the speech frame for the pitch estimation method comprises consecutive samples of a speech waveform. The speech frame comprises at least two pitch periods worth of speech samples. This is to ensure capturing a complete expression of the vocal tract response between two successive glottal pulses. It has been observed that the pitch period generally does not exceed 148 samples at an 8 KHz sampling rate. Thus, in the preferred embodiment, the speech frame comprises at least N=2×148=296 consecutive speech samples.

Now the process of calculating the optimal order-two inverse filter will be described: i.e. step 1015 of FIG. 9. In summary, step 1015 involves calculating a plurality of order-two inverse filters and choosing the optimal order-two inverse filter based on an energy criterion. Each order-two inverse filter is associated with a short segment of the speech frame. To illustrate the calculation of an order-two inverse filter, suppose that an index I is specified. Define the short segment localized at index I as $$s_I(n)=s(n+I),$$

where index n runs from zero to M−1, and s( ) represents a sample of the speech frame. The size M of the short segment is chosen so that the short segment spans less than a pitch period in time duration. An order-two LPC analysis is performed on the short segment localized at index I. The LPC analysis produces coefficients $a_1$ and $a_2$ for an order-two inverse filter with transfer function $1-a_1z^{-1}-a_2z^{-2}$. Since, the short segment of speech data spans less than a pitch period in time duration, the order-two inverse filter obtained from the LPC analysis, and given by coefficients $a_1$ and $a_2$, will model the dominant formant energy but not the pitch energy.

From the coefficients $a_1$ and $a_2$, a pair of reflection coefficients $k_1$ and $k_2$ are calculated according to the relations $$k_1=\alpha_1,$$

$$k_2=\frac{\alpha_1}{1-\alpha_2}.$$

In terms of the reflection coefficients, an energy value E is calculated according to the equation $$E=(1-k_1^2)(1-k_2^2)$$

The energy value E represents the proportion of energy that would remain if the short segment were filtered with the order-two inverse filter given by coefficients $a_1$ and $a_2$. Observe that the order-two inverse filter and energy value depend on the value of index I.

In step 1015, the index I which minimizes the energy value E is located, and the order-two inverse filter which corresponds to the minimizing index is declared to be the optimal order-two inverse filter. In particular, the index I is varied. For each value of the index I, an order-two inverse filter is calculated on the short segment localized at index I; an energy value is calculated for the order-two inverse filter. A search algorithm is employed to locate the index I which minimizes the energy value E.

Figure 10:
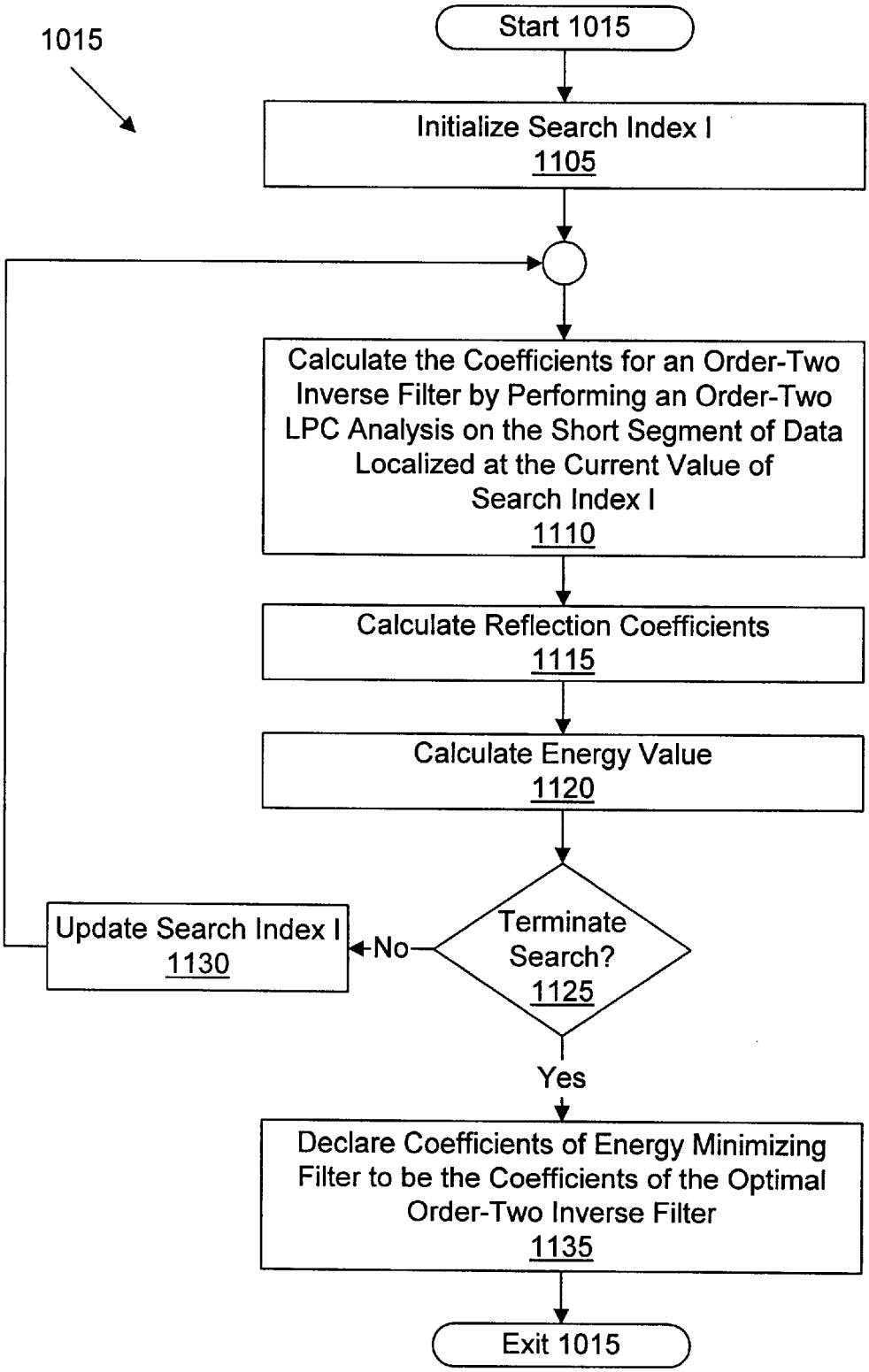
FIG. 10 is a flowchart which illustrates the step (1015 of FIG. 9) of determining an optimal order-two inverse filter.

Please refer now to FIG. 10 which presents a flowchart for step 1015 of FIG. 9. In step 1105, the search index I is initialized. In step 1110, an order-two inverse filter is calculated for the short segment of speech data localized at index I. As mentioned above, an order-two LPC analysis is performed to calculate the coefficients $a_1$ and $a_2$ of the order-two inverse filter. In the preferred embodiment, the LPC analysis may be performed by using the autocorrelation method. However, in alternate embodiments, the covariance method or the Burg method can be used. The autocorrelation method proceeds as follows. First calculate the autocorrelation values $$R(k)=\sum_{m=0}^{M-1-k}s_I(m)s_I(m+k),$$

for k=0,1,2, where $s_1(m)=s(n+I)$. Then solve the 2×2 linear system $$\begin{bmatrix} R(0) & R(1) \\ R(1) & R(0) \end{bmatrix}\begin{bmatrix} \alpha_1 \\ \alpha_2 \end{bmatrix}=\begin{bmatrix} R(1) \\ R(2) \end{bmatrix}$$

for $a_1$ and $a_2$.

In step 1115, a pair of reflection coefficients are calculated from the filter coefficients according to the equations $k_1=a_1$, $$k_2 = \frac{\alpha_1}{1-\alpha_2}.$$

In step 1120, an energy value E is calculated in terms of the reflection coefficients according to the equation $$E=(1-k_1^2)(1-k_2^2).$$

In step 1125, a test is performed to determine whether or not the search for the energy minimizing index I is to be terminated. If the test determines that the search is to continue, step 1130 is performed and then the processing loop is reiterated starting with step 1110. In step 1130, the search index I is updated. In the preferred embodiment of step 1130, the downhill simplex method is used as the search algorithm. However, alternative embodiments of step 1130 are easily conceived which use other search algorithms.

If, in step 1125, the test determines that the search is to terminate, step 1135 is performed. In step 1135, the coefficients $a_1$ and $a_2$ of the energy minimizing filter are declared to be the optimal order-two inverse filter coefficients. In other words, the coefficients $a_1$ and $a_2$ of the energy minimizing filter are assigned to the coefficients $a_1$ and $a_2$ respectively which determine the optimal order-two inverse filter.

In the preferred embodiment of FIG. 10 (step 1015), the parameter M, which determines the size of speech segments, is chosen to be one-half (or one-third) of the pitch period determined from the previous speech frame (i.e. the speech frame prior to the frame currently being analyzed). Since the pitch period varies slowly from frame to frame, this choice for M ensures that M will be smaller than the pitch period of the current frame (i.e. the frame which is currently being analyzed).

In one alternate embodiment of FIG. 10, the parameter M is chosen to be a constant in the range from 10 to 30 samples.

In an alternate embodiment of FIG. 10 (i.e. step 1015), the search index I in step 1130 is updated according to the relation $$I = I + \frac{\tilde{P}}{K},$$

where $\tilde{P}$ is the pitch period determined from the previous speech frame, and K is a positive integer constant greater than or equal to two. In this case, step 1125 terminates the search when the search index I equals $$\frac{(K-1)\tilde{P}}{K}.$$

In this alternate embodiment, K=3 is a preferred value. Thus, the search index I successively takes the value $I_0$, $$I_0 + \frac{\tilde{P}}{3}, \text{ and } I_0 + \frac{2\tilde{P}}{3},$$

where $I_0$ is the initial value of the search index I. In this alternate embodiment, $I_0=0$ is a preferred value.

Figure 11:
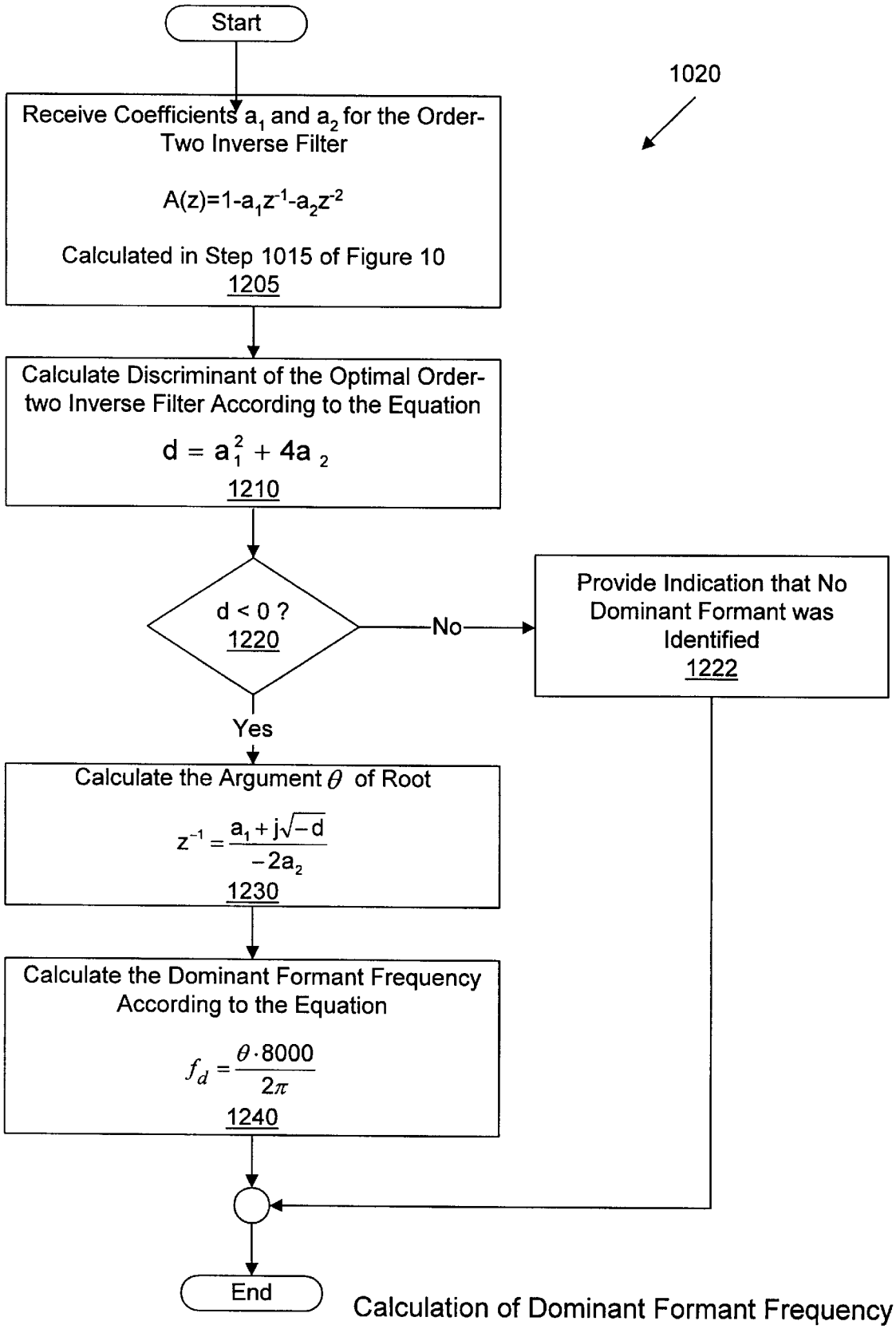
FIG. 11 is a flowchart which describes the step of determining a dominant formant frequency from the optimal order-two inverse filter, i.e. step 1020 of FIG. 9.

Please refer now to FIG. 11 for a flowchart which describes the step of determining a dominant formant frequency from the optimal order-two inverse filter, i.e. step 1020 of FIG. 9. In step 1205, the coefficients $a_1$ and $a_2$, of the optimal order-two inverse filter $A(z)=1-a_1z^{-1}-a_2z^{-2}$ calculated in step 1015 of FIG. 9, are received. In step 1210, the discriminant of A(z) interpreted as a degree two polynomial in $z^{-1}$ is calculated according to the relation.

By definition, the formants occur with frequencies greater than zero. Furthermore, by system design, the formants occurs with frequencies less than half the sampling rate. Therefore, in the complex z-domain, the roots associated with a formant frequency never occur on the real axis. A non-negative value for the discriminant d indicates that the roots of the optimal order-two inverse filter A(z) are real. In this case, it is concluded that the optimal order-two inverse filter A(z) was not able to detect a dominant formant.

Thus, in step 1220, a conditional branching is performed based on the value of the discriminant. If the discriminant d is greater than or equal to zero, then no dominant formant frequency is calculated. In step 1222, a signal is asserted indicating that no dominant formant frequency was calculated for the optimal order-two inverse filter.

If, in step 1220, the discriminant d is negative, then step 1230 is performed. A negative discriminant indicates that the equation A(z)=0 has complex-conjugate roots. These roots are located at angles which are symmetric with respect to the real axis. Thus, the angle of only one of the roots needs to be calculated. The roots of the quadratic equation A(z)=0 are given by $$z^{-1} = \frac{a_1 \pm j\sqrt{-d}}{-2a_2}$$

In step 1230, the argument of the upper-half plane root is calculated:

$$\theta = \mathrm{Arg}\left(\frac{a_1 + j\sqrt{-d}}{-2a_2}\right).$$

This involves calculating the inverse tangent of the ratio $$\frac{\sqrt{-d}}{|a_1|},$$

and then adjusting the angular result to the proper quadrant (I or II) based on the sign of coefficient $a_1$.

In step 1240, the argument θ is converted to a frequency according to the relation $$f_d = \frac{\theta * 8000 \text{ Hz}}{2\pi}.$$

[Recall that the sample rate of the present invention is 8000 Hz.] Thus, the frequency $f_d$ corresponds to the frequency of the dominant formant in the speech frame.

Due to the pseudo-periodic nature of the speech signal, it is normal to observe a strong autocorrelation peak at a time-delays corresponding to the pitch period and its integer multiples (i.e. at P, 2P, 3P, 4P, and 5P, where P is the pitch period). Generally, the amplitude of these correlation peaks decreases for the higher multiples. If a strong peak occurs in the correlation function at a time-delay equal to the dominant formant period $T_d$, and a peak also occurs at each of its integer multiples $2T_d$, $3T_d$, $4T_d$, and $5T_d$, then it is assumed that the pitch period coincides with the dominant formant period. If, however, there are not contributions at all of the other correlation time-delay multiples, then it is assumed that the peak at time-delay $T_d$ corresponds to a strong first formant distinct from the pitch period. [Recall that the first formant is the only formant which occurs with time-delays large enough to be confused with the pitch.] Thus, the peak at time-delay $T_d$ is removed from the list of peaks (actually peak time-delays). Then, the list of remaining peaks is scanned for a series of peaks having the required time-delay structure, i.e. having time-delays equal to 2, 3, 4, and 5 times some fundamental time-delay. The fundamental time-delay is declared to be the pitch period. Since the peak due to the first formant has been removed from the list of peak time-delays, the search process is simplified and less susceptible to error.

Figure 12:
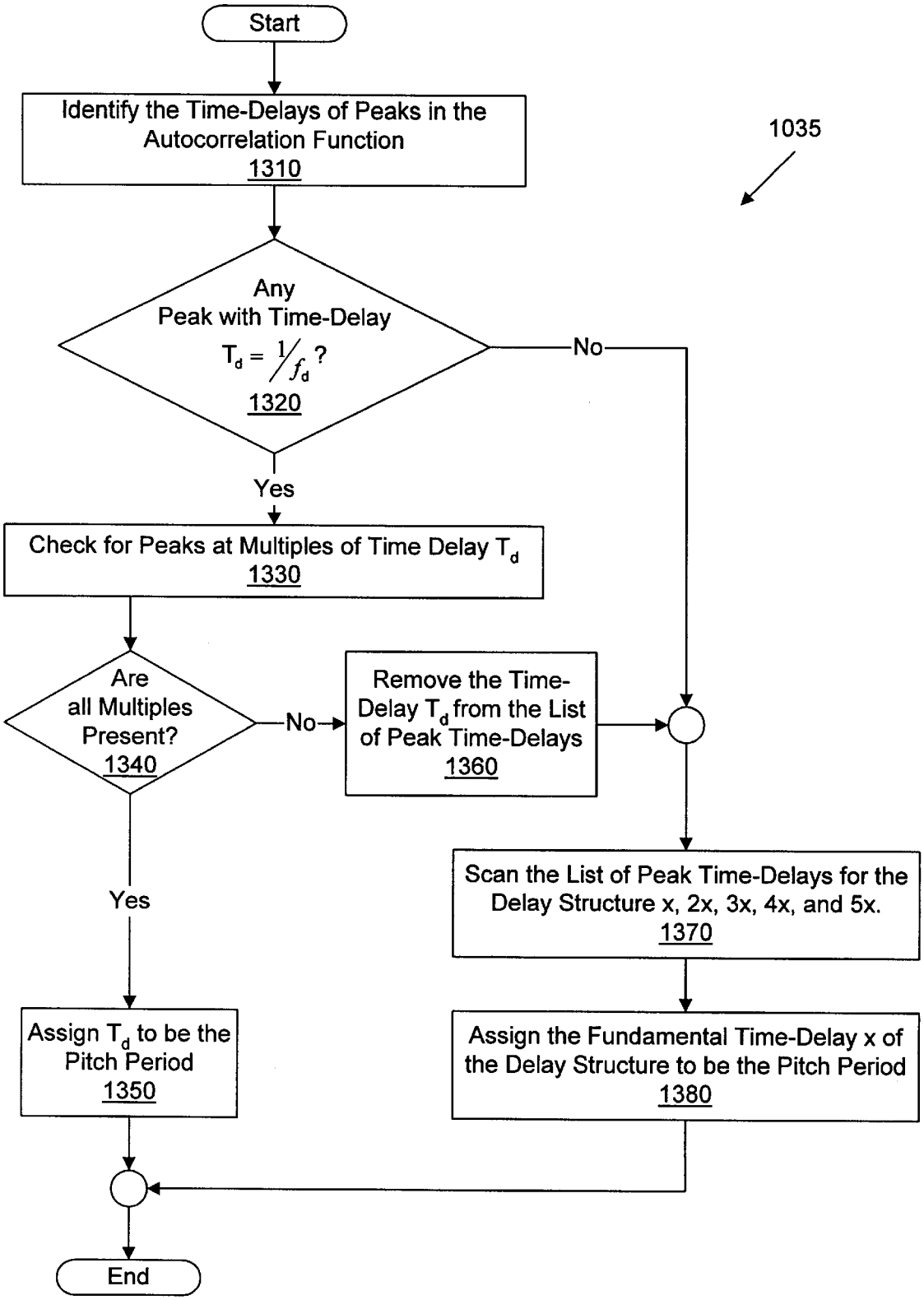
FIG. 12 is a flowchart which illustrates the preferred embodiment of step 1035 of FIG. 9, i.e. the step of analyzing the peaks of the autocorrelation to determine an estimate of the pitch period.

Please refer now to FIG. 12 for a flowchart which illustrates the preferred embodiment of step 1035 of FIG. 9, i.e. the step of analyzing the peaks of the autocorrelation to determine an estimate of the pitch period. In step 1310, the peaks of the autocorrelation function $R(\tau)$ are identified. This involves applying a threshold to the autocorrelation function. Step 1310 results in a list of time-delays which correspond to the locations of peaks in the autocorrelation function.

In step 1320, a conditional branching is performed based on whether or not a peak occurs at the time-delay equal to the period $T_d$ of the dominant formant. The dominant formant frequency $f_d$ was calculated in step 1020 above. The dominant formant period $T_d$ is the inverse of the dominant formant frequency. If a peak occurs at time-delay $\tau=T_d$ plus or minus a system defined tolerance, then step 1330 is performed. Otherwise step 1370 is performed.

In step 1330, the list of peak time-delays is examined to determine whether or not peaks occur at multiples of time-delay $T_d$. In particular, the list of peak time-delays is examined to determine if peaks occur with time-delays $2T_d$, $3T_d$, $4T_d$, and $5T_d$. This examination tests for correspondence within a pre-defined tolerance. In step 1340, a conditional branching is performed based on whether or not all the given multiples of $T_d$ appear as correlation peaks. If all the given multiples of $T_d$ appear in the list of peak time-delays, then step 1350 is performed. In step 1350, the pitch period is declared to be equal to the dominant formant period $T_d$.

If not all the given multiples of $T_d$ appear in the list of peak time-delays, then step 1360 is performed. In step 1360, the time-delay $T_d$ is removed from the list of peak time-delays. In step 1370, the list of peak time-delays is scanned for a collection of time-delays which have the time-delay structure $\{x,2x,3x,4x,5x\}$. In other words, the list of peak time-delays is searched for five time-delays, four of which correspond to the second through fifth multiples of a fundamental time delay. In step 1380, the fundamental time-delay of the collection, i.e. the time-delay corresponding to x, is declared to be the pitch period.

In an alternate embodiment of step 1360, in addition to the time-delay $T_d$, the multiple $2T_d$, is removed from the list of peak time-delays. In a second alternate embodiment of step 1360, in addition to time-delay $T_d$, the second and third multiples of $T_d$ are removed from the list of peak time-delays.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

We claim:

1. A method for performing pitch estimation comprising:

receiving a speech frame comprising a plurality of speech samples;

determining an order-two inverse filter for said speech frame using said plurality of speech samples;

determining a dominant formant frequency from coefficients of the order-two inverse filter;

calculating an autocorrelation function for said speech frame; and estimating a pitch period for said speech frame using said autocorrelation function, wherein said estimating includes using said dominant formant frequency to discriminate a dominant formant from pitch information in the autocorrelation function;

wherein said determining an order-two inverse filter for said speech frame comprises:

computing a plurality of candidate order-two inverse filters at a plurality of locations in said speech frame, wherein said computing generates a set of coefficients for each of said candidate order-two inverse filters;

computing an energy value for each of said candidate order-two inverse filters, wherein said energy value is computed from said set of coefficients of the corresponding candidate order-two inverse filter;

identifying a minimizing order-two inverse filter with a minimum energy value among said plurality of candidate order-two inverse filters as said order-two inverse filter.

2. The method of claim 1, wherein said computing of each of said candidate order-two inverse filters comprises analyzing a number of speech samples which spans less than a full pitch period in time duration.

3. The method of claim 2, wherein said number of speech samples is determined using the pitch value estimated from a previous speech frame.

4. The method of claim 1, wherein said computing a candidate order-two inverse filter comprises performing an order-two Linear Predictive Coding (LPC) analysis.

5. The method of claim 1, wherein said set of coefficients generated for each of said candidate order-two inverse filters includes a pair of filter coefficients $a_1$ and $a_2$.

6. The method of claim 5, wherein said computing an energy value for each of said candidate order-two inverse filters comprises:

calculating a corresponding pair of reflection coefficients $k_1$ and $k_2$ from the corresponding filter coefficients $a_1$ and $a_2$ according to the relations $$k_1 = \alpha_1,$$

$$k_2 = \frac{\alpha_1}{1-\alpha_2}; \text{ and}$$

calculating the energy value from the corresponding reflection coefficients according to the relation $$E=(1-k_1^2)(1-k_2^2).$$

7. The method of claim 5, wherein said determining a dominant formant frequency comprises:

calculating a discriminant d according to the equation $d=a_1^2+4a_2$, wherein $a_1$ and $a_2$ denote the coefficients of the order-two inverse filter;

calculating the angle of the complex number;

$$\frac{a_1 + j\sqrt{-d}}{-2a_2};$$

multiplying said angle by a scaling factor, wherein said scaling factor equals the sampling rate for said speech frame divided by $2\pi$.

8. A system for estimating the pitch period of a speech waveform comprising:

an input for receiving a plurality of speech samples;

at least one processor coupled to said input;

wherein said at least one processor determines an order-two inverse filter based on said plurality of speech samples;

wherein said at least one processor determines a dominant formant frequency from coefficients of the order-two inverse filter;

wherein said at least one processor calculates an autocorrelation function for said plurality of speech samples;

wherein said at least one processor estimates a pitch period for said plurality of speech samples using the autocorrelation function, wherein said at least one processor uses said dominant formant frequency to discriminate a dominant formant from pitch information in the autocorrelation function;

wherein, in determining the order-two inverse filter, said at least one processor:

computes a plurality of candidate order-two inverse filters at a plurality of locations in said speech frame, wherein said computing generates a set of coefficients for each of said candidate order-two inverse filters;

computes an energy value for each of said candidate order-two inverse filters, wherein said energy value is computed from said set of coefficients of the corresponding candidate order-two inverse filter;

identifies a minimizing order-two inverse filter with a minimum energy value among said plurality of candidate order-two inverse filters as said order-two inverse filter.

9. The system of claim 8, wherein in computing each of said candidate order-two inverse filters said at least one processor analyzes a number of speech samples which spans less than a full pitch period in time duration.

10. The system of claim 9, wherein said number of speech samples is determined using the pitch value estimated from a previous speech frame.

11. The system of claim 8, wherein in computing a computing a candidate order-two inverse filter said at least one processor performs an order-two Linear Predictive Coding (LPC) analysis.

12. The system of claim 8, wherein said set of coefficients generated for each of said candidate order-two inverse filters comprises a pair of filter coefficients $a_1$ and $a_2$.

13. The system of claim 12, wherein, in computing the energy value for each of said candidate order-two inverse filters, said at least one processor calculates a corresponding pair of reflections coefficients $k_1$ and $k_2$ from the corresponding coefficients according to the relations $$k_1 = \alpha_1,$$

-continued $$k_2 = \frac{\alpha_1}{1 - \alpha_2};$$

and calculates the energy value according to the equation $$E=(1-k_1^2)(1-k_2^2).$$

14. The system of claim 13, wherein, in determining a dominant formant frequency, said at least one processor:

calculates a discriminant d according to the equation $d=a_1^2+4a_2$, wherein $a_1$ and $a_2$ denote the coefficients of the order-two inverse filter;

calculates the angle of the complex number;

$$\frac{a_1 + j\sqrt{-d}}{-2a_2};$$

multiplies said angle by a scaling factor, wherein said scaling factor equals the sampling rate for said speech frame divided by $2\pi$.

15. A method for performing pitch estimation comprising:

receiving a speech frame comprising a plurality of speech samples;

determining an order-two inverse filter for said speech frame using said plurality of speech samples;

determining a dominant formant frequency from coefficients of the order-two inverse filter;

calculating an autocorrelation function for said speech frame; and estimating a pitch period for said speech frame using said autocorrelation function, wherein said estimating includes using said dominant formant frequency to discriminate a dominant formant from pitch information in the autocorrelation function;

wherein said estimating a pitch period further comprises:

identifying a list of time-delays corresponding to peaks in the autocorrelation function;

setting the pitch period equal to the dominant formant period if the dominant formant period, and its second, third, fourth, and fifth multiples occur in said list of time-delays, wherein said dominant formant period is the inverse of the dominant formant frequency;

removing the dominant formant period from the list of time-delays, and after said removing, scanning a remaining list of time-delays, if it is not the case that the dominant formant period and its first, second, third, fourth, and fifth multiples occur in said list of time-delays.

16. A system for estimating the pitch period of a speech waveform comprising:

an input for receiving a plurality of speech samples;

at least one processor coupled to said input;

wherein said at least one processor determines an order-two inverse filter based on said plurality of speech samples;

wherein said at least one processor determines a dominant formant frequency from coefficients of the order-two inverse filter;

wherein said at least one processor calculates an autocorrelation function for said plurality of speech samples;

wherein said at least one processor estimates a pitch period for said plurality of speech samples using the autocorrelation function, wherein said at least one processor uses said dominant formant frequency to discriminate a dominant formant from pitch information in the autocorrelation function;

wherein in estimating said pitch period said at least one processor:

identifies a list of time-delays corresponding to peaks in the autocorrelation function;

sets the pitch period equal to the dominant formant period if the dominant formant period, and its second, third, fourth, and fifth multiples occur in said list of time-delays, wherein said dominant formant period is the inverse of the dominant formant frequency;

removes the dominant fornant period from the list of time-delays, and after said removal, scans a remaining list of time-delays, if it is not the case that the dominant formant period and its first, second, third, fourth, and fifth multiples occur in said list of time-delays.

* * * * *

UNITED STATES PATENT AND TRADEMARK OFFICE

CERTIFICATE OF CORRECTION

PATENT NO. : 6,026,357

DATED : February 15, 2000

INVENTOR(S) Mark A. Ireton and John G. Bartkowiak

It is certified that error appears in the above-identified patent and that said Letters Patent is hereby corrected as shown below:

Claim 7, col. 15, line 1, please delete the ";" after the word number.
Claim 13, col. 16, line 2, please delete ";" and replace with --,--.
Claim 14, col. 16, line 14, please delete ";" after the word number.
Claim 16, col. 18, line 4, please delete "formant" and replace with "formant".

Signed and Sealed this

Twenty-first Day of November, 2000

*Attest:*

Q. TODD DICKINSON

*Attesting Officer*

*Director of Patents and Trademarks*